United States Patent [19]

Muselet et al.

[11] 4,376,535

[45] Mar. 15, 1983

[54] MACHINE FOR STRINGING RACKETS

[75] Inventors: Andre Muselet; Jacques Muselet, both of Tourcoing, France

[73] Assignee: Snauwaert & Depla, Roselare, Belgium

[21] Appl. No.: 217,891

[22] Filed: Dec. 18, 1980

[30] Foreign Application Priority Data

Feb. 18, 1980 [FR] France ..... 80 04385

[51] Int. Cl.[3] ..... A63B 51/14

[52] U.S. Cl. ..... 273/73 A

[58] Field of Search ..... 273/73 A

[56] References Cited

U.S. PATENT DOCUMENTS

| | | | |
|---|---|---|---|
| 1,969,826 | 8/1934 | Tauber et al. | 273/73 A |
| 2,067,512 | 1/1937 | Sterns | 273/73 A |
| 2,114.216 | 4/1938 | Doll | 273/73 A |
| 3,441,275 | 4/1969 | Held | 273/73 A |
| 3,635,080 | 1/1972 | Krueger et al. | 273/73 A X |
| 3,918,713 | 11/1975 | Kaminstein | 273/73 A |

FOREIGN PATENT DOCUMENTS

| | | | |
|---|---|---|---|
| 2327803 | 5/1977 | France | 273/73 A |

*Primary Examiner*—Richard T. Stouffer
*Assistant Examiner*—Matthew L. Schneider
*Attorney, Agent, or Firm*—Young & Thompson

[57] ABSTRACT

The racket-stringing machine comprises a cradle for locking a racket frame in position and means for applying tension to a racket string. In order to apply tension to the string which is attached to the racket frame, a carriage is located externally of the cradle and provided with means for anchoring the string, for guiding and displacing the carriage in translational motion in the direction of withdrawal or approach with respect to the cradle and for applying tension to the string. The instantaneous tension of the string is compared at each instant with a predetermined tension to be established in order to permit displacement of the carriage in the direction of withdrawal as long as the instantaneous tension is lower than the predetermined tension, the carriage being then locked in position when these tensions are of equal value.

13 Claims, 10 Drawing Figures

77
37
84
86
82
38
92
112
109
106
108
107
114
105
74
78
91
80
79
99
111
V
V
75
104
113
103
131
100

81
80
89
97
94
90
91
105
101
103
108
106
88
87
96
93
95
113
114
102
98

15
29
30
17
28
36
27
34
33
12
14
23
25
31
32
35

MACHINE FOR STRINGING RACKETS

This invention relates to a machine for stringing rackets.

In the majority of current designs, machines for stringing rackets make use of a weight which has to be handled as the stringing operation proceeds in order to apply tension successively to each longitudinal string and to each cross-string.

In addition to the fact that these handling operations are both laborious and tedious, machines of this type are largely dependent on human factors, especially on the manual skill of the racket-stringer. In consequence, irregularities in the tension of strings installed with the aid of these machines are not infrequently observed.

The aim of the present invention is to propose a racket-stringing machine which overcomes the disadvantages attached to the very common types of machines already in use.

To this end, the invention proposes a machine which applies tension to the racket string at the level of a longitudinal string or cross-string by producing a linear displacement of a carriage to which the free end of the racket string is secured, the other end of said string being secured to the racket frame; displacement of the carriage is advantageously controlled by electromechanical means of the electronic control type as a function of a constant comparison between the instantaneous string tension which is imposed by the displacement of the carriage and a tension predetermined as a function of the desired characteristics of the racket and also as a function of the particular sport for which the racket is intended to be used.

It is readily apparent that the machine thus proposed is much more convenient to operate than a machine which makes use of weights and proves to be much more sensitive, on the one hand by reason of the fact that the influence of human factors is completely eliminated and on the other hand by reason of the broad scope offered by this machine in the field of electronic control.

The machine in accordance with the invention offers the further possibility of string tensions applied with a high degree of accuracy within the range of 0 to 30 kg. Although these values are given by way of example and not in any limiting sense, they correspond to the usual range of tensions of all types of rackets designed for different sports, from the Badminton racket which is strung at a tension between 3 and 6 kg to the tennis racket which usually varies in tension between values of the order of 18 to 22 kg.

Taking into account this wide range of possible tension adjustment, another aim of the invention is to make the machine adaptable as a whole to all types of rackets, irrespective of shape or dimensions. In a preferred embodiment, the invention accordingly proposes means for adjusting the cradle for locking the racket in position on the machine as and when the need arises during the racket-stringing operation, thus making the machine in accordance with the invention really universal.

Finally, as will be brought out by the description of a preferred embodiment given hereinafter, the machine in accordance with the invention can be constructed in a particularly simple and economical manner with small overall dimensions while at the same time providing much greater potential capabilities than machines in current use, both in regard to the degree of accuracy achieved and in regard to the range of adjustments provided.

The racket-stringing machine in accordance with the invention comprises a cradle for locking the racket frame in position and means for applying tension to a racket string which is stationarily fixed in one zone of the frame and freely displaceable in sliding motion in a second zone of said frame as a result of a tractive force exerted on one zone of the racket string located beyond the second zone with respect to the first. A distinctive feature of the machine lies in the fact that the tensioning means comprise:

- a carriage located externally with respect to the cradle and adapted to carry means for anchoring the racket-string zone aforesaid;
- means for guiding and displacing the carriage in translational motion in the direction of withdrawal or approach with respect to the cradle in order to apply a tractive force to the racket string;
- means for comparing at each instant the instantaneous tension of the racket string with a predetermined tension to be established and for permitting the translational motion aforesaid in the direction of withdrawal as long as the instantaneous tension of the racket string is lower than the predetermined tension, and for locking the carriage in position when the instantaneous tension of the string is equal to the predetermined tension.

In an advantageous embodiment, the machine under consideration is also designed to permit displacement of the clamp and positioning of this latter with respect to a racket string to be fixed temporarily over the entire surface area defined by the racket frame. In this form of construction, it is also possible to position the clamp outside said surface area, thus permitting the use of the stringing machine for rackets of larger size than those in use at the present time.

The racket-stringing machine in accordance with this advantageous embodiment is distinguished by the fact that said means for temporarily fixing the racket string under tension comprise two substantially horizontal arms placed one above the other in intersecting relation and capable of pivotal displacement about vertical axes which are diametrically opposite with respect to a rotary support disk. The length of each arm is shorter than the distance between the vertical axes aforesaid and the point of intersection of said arms describes at least the entire bottom surface of the racket frame.

These and other features of the invention will be more apparent to those skilled in the art upon consideration of the following description and accompanying drawings, wherein.

The different FIGS. 1 to 6 correspond to a state of rest of the machine, namely to a state prior to tensioning of a length of racket string corresponding to a longitudinal string or to a cross-string.

Figure 1:
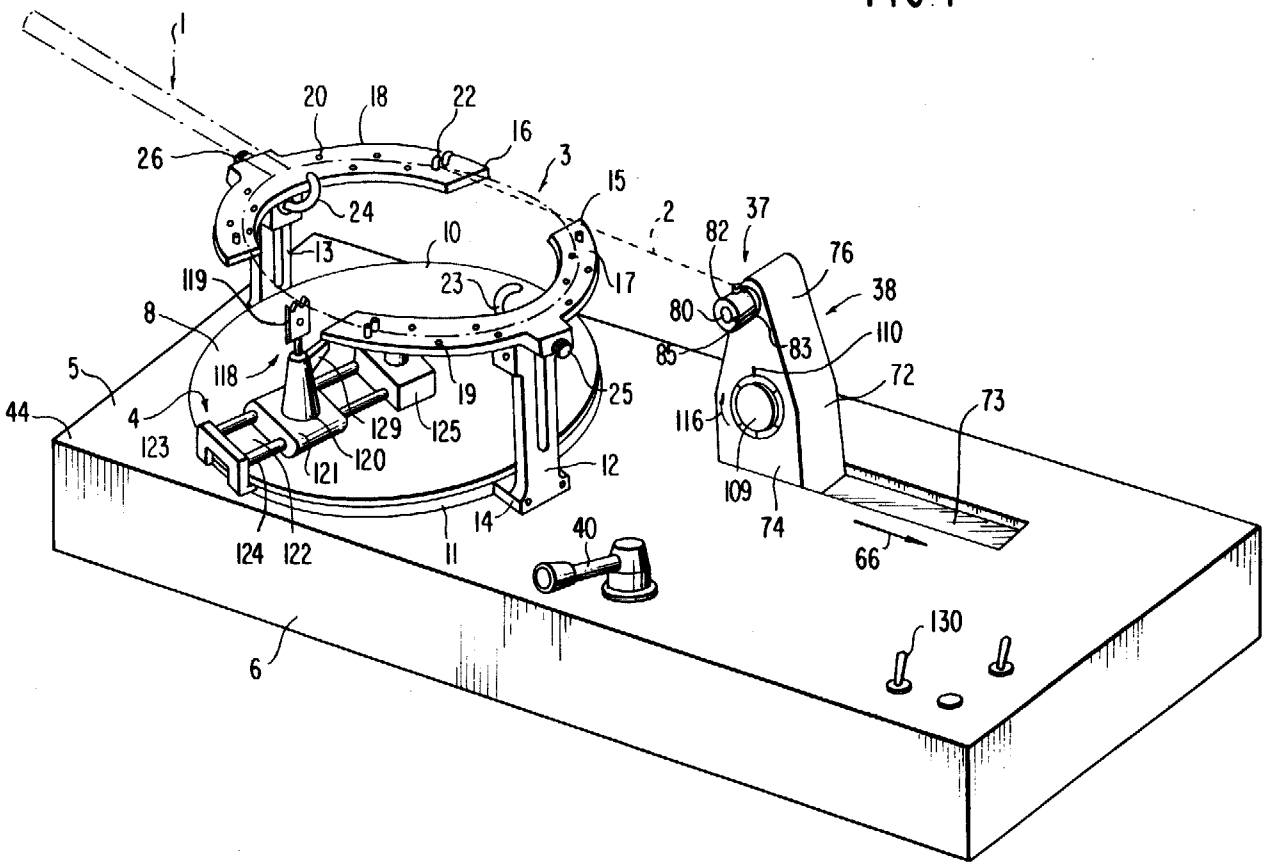
FIG. 1 is a general view in perspective showing a machine in accordance with the invention.

In FIG. 1, a racket 1 is represented diagrammatically by a chain-dotted line and a racket string 2 is represented by a dashed line. It is assumed by way of example that the machine in accordance with the invention is in readiness for tensioning a length corresponding to a longitudinal string.

In order to receive and lock the racket 1 in position, the machine is provided with means 3 which are adjustable on the one hand in order to adapt these latter to all racket shapes and dimensions and thus to permit optimum utilization of the considerable possibilities offered by the tensioning system described hereinafter and, on the other hand, to permit orientation of the racket 1 as a function of the position of the longitudinal string or cross-string to be tensioned.

To this end, the means 3 comprise a horizontal table 4 on the horizontal top face 5 of the base 6 of the machine, said table 4 being wholly of revolution about an axis 7 which is stationary with respect to the base 6 and being mounted on this latter so as to rotate freely about said axis 7.

In the example illustrated, the table 4 has the shape of a disk, the top face 8 of which is flat and the bottom face 9 of which carries a continuous skirt 11 designed both internally and externally in the shape of a cylinder of revolution about the axis 7 and set back towards said axis 7 with respect to its circular periphery 10.

In diametrically opposite positions, the external cylindrical periphery of the skirt 11 carries two identical arms 12 and 13 respectively which are substantially vertical and each form a projecting portion of identical height above the top face 8 of the table 4 for reasons which will become apparent hereinafter. Each arm 12 and 13 is joined to the external cylindrical periphery of the skirt 11 by means of a radially projecting horizontal flange such as the flange 14 which is intended to maintain the arm at a distance from the periphery 10. In addition, since said flange is located at a distance from the face 9, it is also intended to free that zone of said face which is located between the cylindrical external periphery of the skirt 11 and the periphery 10.

At the upper end and at a level which is identical with respect to the face 8 of the table 4, the arms 12 and 13 are each adapted to carry a half-cradle having the shape of a horizontal crescent and are designated respectively by the reference numerals 15 and 16. The two half-cradles 15 and 16 having oppositely-facing concave portions substantially reproduce the shape of two opposite zones of a racket frame and are thus capable of supporting said zones of the frame.

To this end, the two half-cradles 15 and 16 have coplanar horizontal top faces 17 and 18 respectively and each half-cradle is provided with a plurality of vertical holes 19 and 20 respectively. Said holes are distributed on the top face of said half-cradle in order to mount horizontal jacks such as 21 and 22 respectively in the most suitable positions on said top face, taking into account the shape and dimensions of the racket frame to be strung. Said jacks are so arranged as to bear on the external periphery of the racket frame in order to lock this latter in position on the assembly constituted by the half-cradles 15 and 16. In order to carry out positional locking of the frame, hooks 23 and 24 respectively are additionally provided within the concave portion of each half-cradle in diametrically opposite positions with respect to the axis 7 and projecting above the faces 17 and 18, said hooks being adapted to bear centrifugally on the internal periphery of the racket frame; to this end, each hook 23 and 24 is adjustable in a radial direction with respect to the corresponding half-cradle by means of a knurled knob designated respectively by the reference numerals 25 and 26.

In order to permit adaptation of the machine to racket frames having very different dimensions, the two half-cradles 15 and 16 are also mounted on the upper ends of the arms 12 and 13 respectively by making use of means which permit positional adjustment of said half-cradles in the same radial and horizontal direction.

In connection with the arrangements just mentioned, reference will be made more particularly to FIG. 3 which illustrates the arm 12, it being understood that the arm 13 is of identical design.

Figure 3:
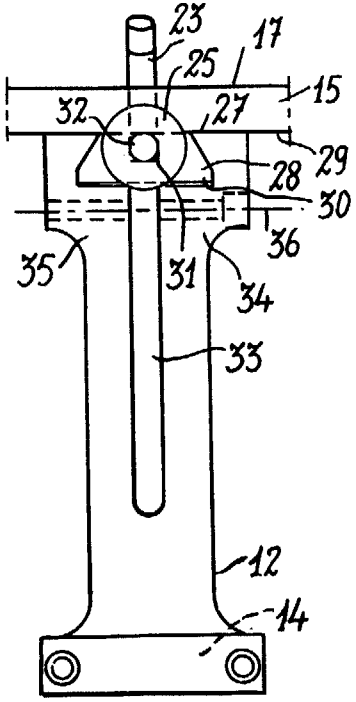
FIG. 3 is a detail view showing an arm which provides a connection between one of the two adjustable half-cradles for receiving the racket to be strung and the racket orientation table.

FIG. 3 is a view of the arm 12 taken in a radial direction towards the axis 7. It is apparent from this figure that the arm 12 has a flat horizontal top face 27 within which is formed a horizontal dovetail groove 28 which is oriented in a radial direction. As a complementary feature, the half-cradle 15 has a flat horizontal bottom face 29, one zone of which is adapted to rest on the top face 27 of the arm 12. Provision is also made for a horizontally and radially oriented rib 30 which forms a projection beneath the face 29 and the dovetail profile of which is complementary to that of the groove 28. A bore 31 is formed within said rib 30 and a rod 32 is slidably mounted within said bore, said rod being integral with the hook 23 within the concave portion of the half-cradle 15 and adapted to carry the knurled knob 25 at the level of the convex portion of said half-cradle. Said knob can be screwed on the rod 32 to a greater or lesser extent by rotation so as to adjust the position of the hook 23 with respect to the half-cradle 15.

Thus the half-cradle 15 is capable of sliding in a horizontal and radial direction on the horizontal top face 27 of the arm 12 in order to permit locking in a position which is most suitably adapted to the shape and dimensions of the racket frame to be strung. The arm 12 is designed as a clamp and is provided for this purpose with a vertical slot 33 which extends from one end to the other along a plane which includes the axis 7 and the axis of the bottom of the groove 28. The slot 33 begins at the bottom of said groove 28 and extends over a distance corresponding to the greater part of the height of the arm 12. Said slot 33 defines at the upper end of the arm 12 two jaws 34 and 35 respectively, each jaw being such as to correspond to one of the sides of the groove 28. The rib 30 can be locked in position at will within the groove 28 by tightening the two jaws 34 and 35 by means of a screw which passes through the jaws from one side to the other in a direction 36 at right angles to the mid-plane of the slot 33 (said screw has not been shown in the drawings). It will be noted that, by reason of the dovetail shape of the groove 28 and of the rib 30, tightening of the jaw 34 is accompanied by application of the bottom face 29 of the half-cradle 15 against the top face 27 of the arm 12, thus ensuring a constant level of the top face 17 of the half-cradle 15 with respect to the table 4, irrespective of the adjustment which is adopted. Similar means are adopted for adjusting the half-cradle 16 in a radial direction at the top of the arm 13, thus ensuring a constant coplanar relationship between the respective top faces 17 and 18 of the two half-cradles 15 and 16 irrespective of the adjustment of these latter. In other words, regardless of its shape and dimensions, a racket 1 is always locked in position at the same level on the machine and rotational displacement of the table 4 about the axis 7 is accompanied by a displacement of the racket along its mid-plane which remains stationary.

Approximately at this level, the machine is provided with means 37 for anchoring the racket string in a zone which is always located externally of the cradle constituted by the two half-cradles 15 and 16, namely away from the vertical projection of the table 4, said anchoring means being carried by an assembly 38 which serves to apply tension to said racket string and which will be described hereinafter.

Rotational displacement of the table 4 about its axis 7 makes it possible to present the racket successively in those positions with respect to the anchoring means 37 and the tensioning assembly 38 which are the most suitable for successive stringing respectively of each longitudinal string and of each cross-string. The most suitable position for stringing a longitudinal string or a cross-string corresponds to a position in which the length of racket string to be tensioned is held stationary in a first zone of the racket frame and capable of sliding with respect to a second zone of said frame and is secured temporarily to the anchoring means 37 beyond said second zone with respect to the first while ensuring that the string is as rectilinear as possible.

In order to permit locking of the table 4 successively in the most suitable different positions, provision is made within the base 6 for braking means 39 which will now be described more particularly with reference to FIG. 2.

Said braking means 39 are manually operated by means of a handle 40 located above the face 5 of the base 6 and capable of rotating about a vertical axis with respect to this latter between three notch positions corresponding respectively to total freedom of rotation of the table 4 about the axis 7, to a slight-braking position which permits manual rotation of the table 4 about the axis 7 by means of a low effort for reasons of convenience of operation, and a position of secure locking of the table 4 with respect to the base 6 during a tensioning operation.

Figure 2:
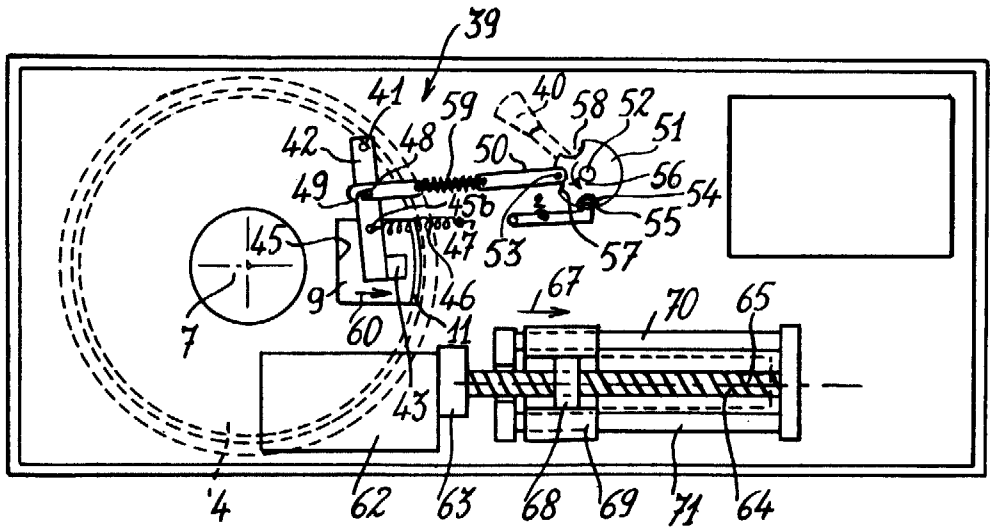
FIG. 2 is a bottom view of said machine.

The braking means 39 are illustrated in FIG. 2 in the first of these three positions.

In the example illustrated, the braking means 39 comprise a horizontal lever 42 pivotally mounted at one end on a vertical pin 41 which is stationary with respect to the base 6 of the machine. Said lever is so arranged with respect to the axis 7 that, in its three positions corresponding to the three notch positions of the operating handle 40, said lever 42 is oriented along a chord of the cylindrical internal periphery of the skirt 11 of the table 4 at a level which is slightly lower than the bottom level of said skirt.

At the upwardly curved second end of said lever which traverses the horizontal top wall 44 of the base 6 through a slot 45 of this latter, said lever 42 is adapted to carry a shoe 43 which is placed opposite to the cylindrical internal periphery of the skirt 11. The application of the shoe 43 against said internal periphery results in either slight or powerful braking of the table 4 as a function of the pressure exerted.

Between its two ends, the lever 42 is adapted to carry an anchoring point **45*b* for one end of a coil spring 46; the other end of said spring is connected to a point 47 which is stationary with respect to the base 6 in a position such that said spring 46 applies a constant resilient tractive force on the lever 42 which tends to cause this latter to pivot about the pin 41 in the direction of application of the shoe 43 against the cylindrical internal periphery of the skirt 11 of the table 4. Provision is also made between the two ends of the lever 42 for a vertical lug 48 engaged in an oblong slot 49 of a horizontal connecting-rod 50 between the lever 42 and a cam 51 which is coupled to the operating handle 40 for rotational motion about a vertical pin 52 within the base 6. The connecting-rod 50 is pivotally mounted on said cam 51, at one end opposite to the end provided with the slot 49, about a vertical pin 53 which is displaced off-center with respect to the pin 52**.

These elements are positioned in such a manner as to ensure that the connecting-rod 50 of rectilinear shape is oriented transversely with respect to the general direction of the lever 42, irrespective of the position of the cam 41 and the corresponding position of the lever 42.

In the example illustrated, the cam 51 is located on the same side of the lever 42 as that zone of the cylindrical internal periphery of the skirt 11 against which the shoe 43 is intended to be applied, and opposite to this latter.

The operation of the braking means 39 will now be described.

In the position illustrated which corresponds to freedom of rotation of the table 4 about its axis 7, the pivot-pin 53 is located between the pivot-pin 52 and the lever 42 whilst the lug 48 is in contact with that end of the slot 49 which is nearest the pivot-pin 53; the connecting-rod 50 applies to said lug 48 a thrust which maintains the shoe 43 at a distance from the cylindrical internal periphery of the skirt 11. The engagement of a roller 55 within a first slot 54 of the otherwise circular periphery of the cam 51 corresponds to this first position. Suitable means tend to move said roller 55 elastically towards the pivot-pin 52 against the periphery of the cam 51.

In a second position of the braking means 39 corresponding to rotation of the operating handle 40 and of the cam 51 in the direction of the arrow 56 of FIG. 2, which brings the roller 55 into a second notch 57 of the periphery of the cam 51, the lug 48 occupies an intermediate position between the two ends of the oblong slot 49 of the connecting-rod 50, said slot being oriented in the general direction of the connecting-rod, and the spring 46 applies the shoe 43 elastically against the cylindrical internal periphery of the skirt 11 of the table 4; this position corresponds to slight braking of the table 4.

Finally, in a third position corresponding to the continued rotation of the handle 40 and of the cam 51 in the direction of the arrow 56 about the pivot-pin 52, the roller 55 engages in a third notch 58 of the periphery of the cam 51 and the lug 48 is in contact with that end of the slot 49 which is remote from the pivot-pin 53 while the connecting-rod 50 applies to the lever 42 a tractive force which has the effect of firmly applying the shoe 43 against the cylindrical internal periphery of the skirt 11 of the table 4, with the result that said table is completely secured against rotation about its axis 7.

Suitable means 59 are provided for permitting length adjustment of the connecting-rod 50 so as to ensure that one of the positions of the shoe 43 defined in the foregoing corresponds effectively to each of the three notch positions of the cam 51. The arrow 50 in FIG. 2 indicates the movement of the shoe 43 which accompanies the movement of rotation of the cam 51 in the direction of the arrow 56.

It would clearly be possible to contemplate other forms of construction of the means for braking the table 4 without thereby departing from the scope of the invention. Similarly, it would be possible to contemplate adaptation of the invention to the different shapes and sizes of rackets by making use of means other than those hereinabove described.

In addition to the braking means 39, FIG. 2 shows preferred means for subjecting the anchoring means 37 in accordance with the invention to a movement of translation substantially parallel to the mid-plane of the racket which is locked in position on the two half-cradles 15 and 16, the result of this movement being to apply tension to a length of the racket string.

In the particularly simple embodiment which is illustrated, the means aforementioned comprise an electric motor 62, the output shaft of which is engaged with a lead-screw 64, if necessary by means of a reduction-gear set 63, said lead-screw being thus driven in rotation about its horizontal axis in either one direction or the other according to requirements. Said axis 65 is oriented in the desired direction of translational motion of the anchoring means 37 (this direction is that of the arrow 66 of FIG. 1 and of the arrow 67 of FIG. 2; these arrows indicate the direction of translational motion of the anchoring means 37 corresponding to an increase in tension of the racket string).

The thread of the screw 64 is engaged with a nut 68 which is rotationally fixed with respect to the base 6 of the machine. In consequence, the rotation of the screw 64 respectively in one direction or in the other produces a translational movement of the nut 68 in a direction parallel to the axis 65 respectively in one direction or in the other.

Said nut 68 is rigidly fixed to a carriage 69 which is guided in translational motion in a direction parallel to the axis 65 with respect to the base 6, for example by means of two stationary rectilinear guides 70 and 71 which are parallel to said axis 65. By way of example, the guides 70 and 71 are defined by rectilinear rods, complementary sleeves of the carriage 69 being slidably mounted on said rods and advantageously lined with any suitable material for improving the sliding action.

The top of the carriage 69 is adapted to carry a casing 72 which is rigidly fixed to this latter and in turn adapted to carry anchoring means 37. Said casing 72 passes through a rectangular slot 73 formed in the top wall 44 of the base 6 and extends in a direction parallel to that of the axis 65 so as to permit displacement of the assembly formed by the carriage 69 and the casing 72 in this direction as a result of rotation of the screw 64. As an advantageous feature, the zone of the slot 73 which is freed when the casing 72 occupies a predetermined position is shut-off by means of a shutter which slides along the wall 44 in fixed relation to the carriage 69.

The casing 72 has the double function of transmitting the translational motion of the carriage 69 to the anchoring means 37 and of protecting the means for comparing the instantaneous tension of the racket string with a predetermined and adjustable tension.

These means will now be described more particularly with reference to FIGS. 4 to 6.

Figure 4:
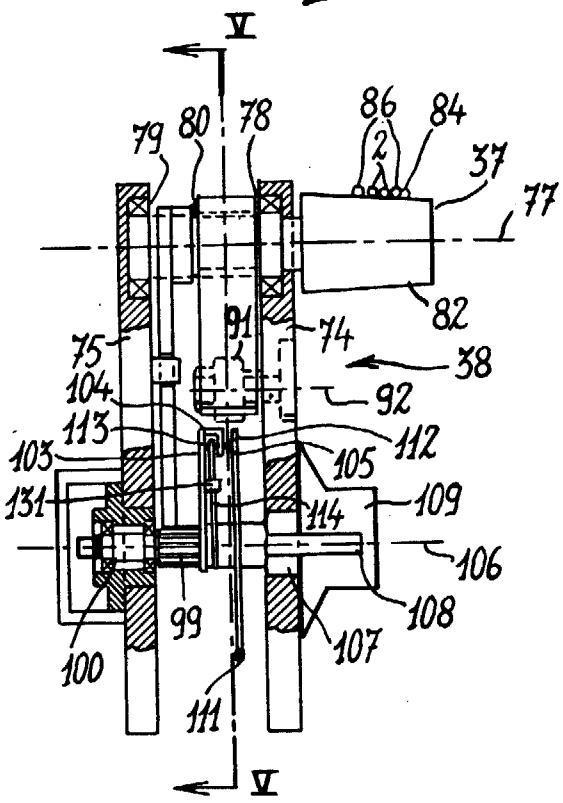
FIG. 4 shows all the means employed for comparing the instantaneous tension of the racket string with a predetermined tension and for adjusting said predetermined tension, this view being taken in a direction corresponding to the direction of displacement of these elements corresponding to application of increasing tension to the racket string.
Figure 5:
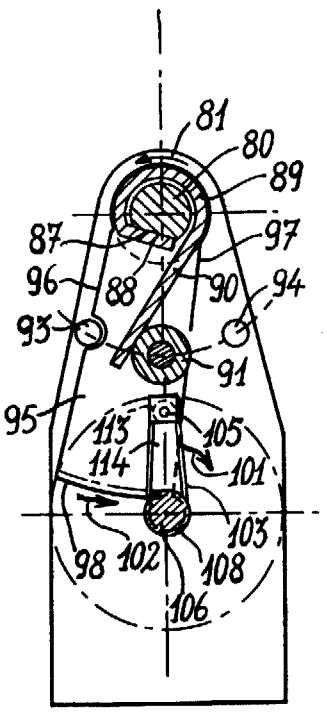
FIG. 5 is a sectional view taken in a plane V—V of FIG. 4.

In the example illustrated, the casing 72 has two vertical cheeks 74 and 75 which are parallel to each other and parallel to the direction of displacement of the carriage 69 to which said cheeks are directly attached through the rectangular slot 73, and further comprises a cover 76 which has been removed in FIGS. 4 and 5.

At the upper ends thereof, the two cheeks 74 and 75 are adapted to carry bearings 78 and 79 respectively; said bearings define a horizontal axis of rotation 77 located in a plane at right angles to the direction of displacement of the carriage 69 for a substantially cylindrical shaft 80 of revolution about said axis 77.

Said shaft 80 passes through the cheek 74 from one side to the other and is adapted to carry the racket string anchoring means 37 in that zone of the shaft which is located outside the space between the two cheeks.

The means 37 aforementioned are so designed as to ensure that tensioning of the racket string by translational motion of the assembly 38 in the direction of the arrow 66 produces a reaction which tends to initiate pivotal displacement of the rigidly coupled assembly formed by said means 37 and the shaft 80 about the axis 77 with respect to the cheeks 74 and 75 in the direction of the arrow 81 of FIG. 5.

By way of example, the means 37 are constituted by a self-tightening clamp comprising a jaw 82 rigidly fixed to the shaft 80 and a jaw 83 pivotally mounted on the jaw 82. These two jaws define conjointly a slightly frusto-conical periphery 84 of revolution about the axis 77 for receiving the racket string which is wound on said periphery. Between said jaws, a slot 85 is capable of receiving a short length of the racket string and of securing this latter by clamping since winding of the string on the periphery 84 produces a tightening action on the jaws.

Said periphery 84 is adapted to carry two adjacent nipples 86 along its top generator-line which corresponds to a zone of the jaw 82. A precise position of the racket string 2 which is wound around the periphery 84 is defined between said nipples in order to ensure tightening of the clamp.

A flat surface 87 is formed on the underside of the shaft 80 between the cheeks 74 and 75 and in the zone located nearest the cheek 74 in the example shown in the figure. A flattened end 88 of a helical spring 89 is fixed against said flat surface 87 and describes at least a portion of a helical turn around the cylindrical periphery of the shaft 80. A second flat end 90 of said spring is abuttingly applied against the periphery of a roller 91 which is mounted so as to be capable of rotating freely on the cheek 74 about an axis 92 which is parallel to the axis 77. The spring 89, the flat surface 87 and the roller 91 are so arranged as to ensure that the spring tends to apply an elastic restoring force to the shaft 80 in the direction opposite to the arrow 81 when tensioning of the racket string produced by displacement of the assembly 38 in the direction of the arrow 66 tends to produce a combined movement of rotation of the anchoring means 37 and of the shaft 80 in the direction of said arrow 81.

An equilibrium is thus established at each instant of tensioning of the racket string between the effect of instantaneous tension of this latter and the elastic reaction of the helical spring 89. This equilibrium is represented by a movement of rotation of greater or lesser amplitude of the shaft 80 in the direction of the arrow 81 and the instantaneous value of this movement of rotation indicates the instantaneous value of tension applied to the racket string.

Means other than a helical spring 89 could be employed for causing a reaction of the shaft 80 to the action of the tensioned racket string. It will be noted, however, that a helical spring such as the spring 89 has an advantage in that it is capable of linear deformation as a function of a torque exerted on said spring about the axis 77. In other words, inasmuch as the action produced by the tension of the racket string and by the helical spring 89 is balanced at each instant, the instantaneous value of rotation of the anchoring means 37 about the axis 77 with respect to a position corresponding to a zero tension of the string and to zero tension of the helical spring 89 is a linear function of the instantaneous value of the string tension. This facilitates display of the predetermined tension to be established in the racket string as will be described hereinafter.

In order to limit the value of rotation of the anchoring means 37 and of the shaft 80 about their common axis 77, provision is made on the cheek 75 for two stops designated respectively by the reference numeral 93 on the upstream side and by the reference numeral 94 on the downstream side, taking account of the direction of the arrow 81. In addition, the shaft 80 is adapted to carry a downwardly extending member which is located next to the cheek 75 and rigidly fixed to said shaft. One edge 96 of said member 95 (namely the edge located on the upstream side with reference to the direction of the arrow 81) is applied against the stop 93 when the tension of the spring is zero. A second edge 97 of said member 95 (this edge being located on the downstream side with reference to the direction of the arrow 81) is applied against the stop 94 when the tension of the helical spring 89 is of maximum value, which corresponds to a maximum value of tension applicable to a racket string by means of the machine in accordance with the invention, that is to say to an effort of thirty kilograms, for example.

It is worthy of note that the assembly located between the stops 93 and 94 and formed by the shaft 80 together with the members carried by said shaft in rigidly fixed relation to this latter has a small range of angular displacement of the order of forty degrees, for example. Means are provided for linearly amplifying the movement of rotation of the shaft 80 in order to produce a significant image of this movement and also in order to offer possibilities of more accurate adjustment of the racket-string tension as indicated by the rotation of the shaft 80.

To this end, the member 95 is partially delimited at the lower end by an edge 98 of revolution about the axis 77 and adapted to carry a set of gear teeth disposed in meshing engagement with the teeth of a pinion 99 which is rotatably mounted on the cheek 75 about an axis 100 which is parallel to the axis 77. The reduction ratio between the member 95 and the pinion 99 is of high value, with the result that the rotation of the member 95 between the two stops 93 and 94 produces a movement of rotation of the pinion 99 about the axis 100 through an angle which is as close as possible to 360° in a direction indicated by the arrow 101 of FIG. 5 when the shaft 80 rotates in the direction of the arrow 81; the member 95 naturally rotates in the same direction as the shaft 80 as indicated by the arrow 102 of FIG. 5.

At the end remote from the cheek 75 and at a point located approximately half-way between the cheeks 74 and 75, the pinion 99 is adapted to carry a radial arm 103 which is rigidly fixed on this latter and has the maximum radius compatible with the possibilities of rotation of said arm within the interior of the cover 76 of the assembly 38.

At the end remote from the pinion 99, said arm 103 is adapted to carry a flange 104 which is directed towards the cheek 74 and parallel to the axis 100. At the end of said flange 104 which is nearest the cheek 74 and therefore located between the arm 103 and said cheek 74, the arm 103 also carries a small plate 105 forming a return from said flange 104 towards the axis 100 in a direction parallel to said arm 103. Said small plate 105 constitutes a flag which indicates the instantaneous position of the arm 103 as this latter rotates about the axis 100, namely the instantaneous position of the shaft 80 about the axis 77 as well as the instantaneous tension of the racket string 2.

Various means may be adopted for detecting said instantaneous position of the small plate 105 such as, for example, optoelectronic proximity detectors, a set of two high-frequency induction coils placed on each side of the path necessarily followed by the small plate 105 when the arm 103 rotates about the axis 100. Accordingly, the small plate 105 or other equivalent means are designed in the most suitable manner as a function of these detection means.

In the example illustrated in which, as will hereinafter be explained in detail, detection of the instantaneous position of the small plate 105 is carried out by interruption of a magnetic field, said small plate 105 is formed of material which is capable of constituting a magnetic screen, that is to say of soft iron, whereas the arm 103 is formed of non-magnetic material.

The means for detecting the position of the small plate 105 and adjusting the predetermined tension to be established in the racket string will now be described more particularly with reference to FIGS. 4 and 6.

These means are carried by the cheek 74 on which they are mounted so as to be capable of rotating about a horizontal axis 106 which coincides with the axis 100.

To this end, a shaft 108 which is substantially cylindrical of revolution about the axis 106 passes right through the cheek 74 and is provided with a bearing 107 in order to facilitate rotational motion of said shaft about the axis 106.

Outside the space between the cheeks 74 and 75, a graduated knob 109 is fixed on the end of the shaft 108 in order that the tension which it is desired to exert on the racket string may be displayed opposite to a reference mark or pointer 110 which is placed on the cheek 74 (as also shown in FIG. 1).

Figure 6:
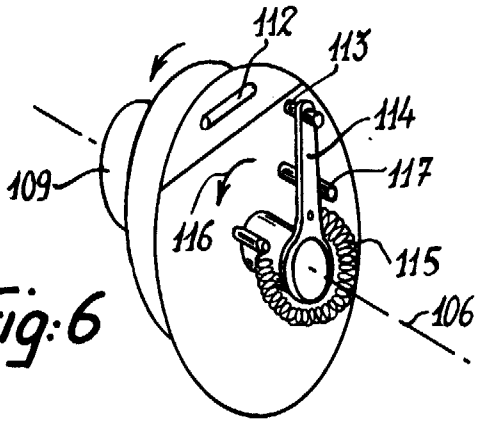
FIG. 6 is a view in perspective showing the means adopted for regulating the predetermined tension to be established in the racket string.

The position of the knob 109 illustrated in FIGS. 4 to 6 corresponds to the display of a zero value of said tension.

Between the two cheeks 74 and 75, the shaft 108 also carries a rigidly fixed radial disk 111 located between the cheek 74 and the path necessarily followed by the small plate 105 during rotation of this latter about the axis 100. The respective radii of the disk 111 about the axis 106 and of the arm 103 about the axis 100 have substantially similar values.

Said disk 111 is adapted to carry a flexible-blade switch 112 which is located near the periphery of the disk opposite to the intended path of the small plate 105 when this latter rotates about the axis 100 and which is located opposite to the small plate 105 itself when the predetermined tension displayed by means of the knob 109 is zero and when the racket-string tension is also zero. that is to say when the member 95 is in contact with the stop 93 (namely in the position illustrated). The design function of said switch 112 is to control the operation of the motor 62 by closing the circuit for supplying current to the motor when said switch is subjected to the action of a magnetic field applied opposite to that face of the disk 111 on which the switch is fixed, with a view to initiating operation of the motor 62 in the direction of displacement of the carriage 68 (that is, in the direction of the arrow 67) and with a view to opening said circuit and also stopping the motor 62 as instantaneously as possible when the action of the magnetic field is discontinued.

When the small plate 105 is not located opposite to the flexible-blade switch 112, the magnetic field aforementioned is applied to said switch by a permanent magnet 113 carried by an arm 114 disposed radially with respect to the axis 106 and located between the respective intended paths of the small plate 105 and of the arm 103 at the time of rotation of this latter about the axis 100.

The arm 114 is mounted so as to be capable of rotating about the axis 106 with respect to the shaft 108 but is returned elastically against a stop 117 by a spring 115 in the direction opposite to that of an arrow 116 corresponding to rotation of the rigidly coupled assembly consisting of disk 111 and knob 109 in the direction of display of increasing tension, the direction of said arrow 116 being the same as the direction of the arrow 101. The stop 117 aforementioned is adjustable so as to ensure that, when the arm 114 is in contact with said stop 117 under the action of the spring 115, the magnet 113 is placed directly opposite to the flexible-blade switch 112.

Thus the operation which consists in applying tension to a length of racket string 2 corresponding, for example, to a longitudinal element as illustrated in FIG. 1 is carried out as follows: the racket string is securely attached to the frame of the racket in the zone which is farthest away from the anchoring means 37. Depending on requirements, this attachment may be either permanent as a result of knotting, for example, or temporary by means of a movable clamp or by means of a clamp 118 which is integrated with the machine as will hereinafter be described and which is capable of sliding freely with respect to the racket frame in the zone nearest the anchoring means 37.

In a first step during which the motor 62 is stopped in a position of the lead-screw 64 in which the carriage 69 of the tensioning assembly 38 is nearest the table 4, a racket-string zone located externally of the racket frame is fixed on the anchoring means 37. In the example illustrated, this operation is performed by winding said racket-string zone around the periphery 84 of the anchoring means 37 and then engaging a racket-string zone adjacent to the wound zone between the two jaws 82 and 83 in which said adjacent zone is secured by clamping as a result of the winding operation.

The tension to be applied to the length of racket string under consideration is then displayed by means of the knob 109. In the case of the preferred example illustrated in the drawings, this display is effected by rotating the knob 109 in the direction of the arrow 116 through an angle which is proportional to the tension to be established, with respect to that position of said knob which corresponds to display of zero tension.

The effect thereby achieved is to displace conjointly through the same angle both the flexible-blade switch 112 and the magnet 113 which had initially been separated from each other by the small plate 105 as a result of the zero tension of the racket string and which are now withdrawn from said small plate 105, whereupon the magnet 113 initiates closure of the flexible-blade switch 112 within the circuit for supplying current to the motor 62.

The operator then starts-up the motor 62 by closing a switch 130 which is also interposed in the supplying circuit of the motor so as to initiate a displacement of the carriage 69 in the direction of the arrow 67 and conjointly a displacement of the tensioning assembly 38 including the anchoring means 37 in the direction of the arrow 66.

Taking into account the powerful anchoring action of the racket string on the means 37 and the capacity of these latter for rotational displacement about the axis 77 while stretching the helical spring 89, the aforementioned displacement of the carriage and tensioning assembly is accompanied by progressive tensioning of the length of racket string and by a simultaneous movement of rotation of the shaft 80 together with the different elements fixed thereon in accordance with a linear function of said tension in the example illustrated, by reason of the design characteristics of the spring 89.

In particular, the rotation of the shaft which takes place in the direction of the arrow 81 is accompanied by a movement of rotation of the arm 103 and of the small plate 105 in the direction of the arrow 101, with the result that the small plate 105 moves progressively towards the flexible-blade switch 112 and the magnet 113 which are still placed opposite to each other. Then, when the tension displayed by means of the regulating knob 109 is attained, the small plate 105 is interposed between the switch 112 and the magnet 113; this results on the one hand in opening of the current supply circuit of the motor 62 and on the other hand is abrupt braking of said motor by means of a system of relays which are preferably electronic and the constructional design of which is within the capacity of anyone versed in the art. The braking action has the intended effect of abruptly stopping the movement of translation of the carriage 69, of the tensioning assembly 38 and of the anchoring means 37, namely of stationarily fixing the length of racket string in the desired state of tension. By way of example, if a motor 62 of the alternating-current type is employed, abrupt braking of the motor can be carried out by abrupt injection of a direct-current voltage in the motor windings. It is readily apparent, however, that other means can be contemplated without thereby departing from the scope of the invention.

As a general rule, after completion of this initial tensioning operation,, the racket string slackens whereas the assembly 38 remains motionless; this gives rise to a movement of rotation of the shaft 80 and associated elements about the axis 77 in the direction opposite to the arrow 81. The final result of this movement of rotation is to free the flexible-blade switch 112 and the magnet 113 from the action of the small plate 105, thus again starting-up the motor 62 so as to displace the carriage 69 in the direction of the arrow 67 and to displace the tensioning assembly in the direction of the arrow 66 until the tension displayed is again attained, whereupon the small plate 105 is again interposed between the elements 112 and 113 so as to cause abrupt stopping of the motor 62. This process can be repeated automatically. When a long period of time elapses between two successive restarts of the motor 62, it is considered that the tension of the length of racket string has become stabilized. That zone of said length of racket string which had initially been slidably mounted with respect to the racket frame is then stationarily fixed with respect to this latter by means of a movable clamp or by means of the clamp 118 which will be described hereinafter. The length of racket string is then detached from the anchoring means 37 and slidably engaged in another zone of the racket frame, for example in order to define the following longitudinal string or the following cross-string. The operation is then repeated after having returned the assembly 69-38 by hand to its initial position.

Various means can be employed for temporarily immobilizing one zone of the racket string with respect to the racket frame. However, there is shown in FIG. 1 a clamp system which is especially adapted to the possibilities of adjustment of the two half-cradles 15 and 16 as a function of a very wide range of shapes and sizes of racket frames.

Said clamp system 118 comprises a clamp 119 proper of a type known per se which is freely displaceable in vertical sliding motion and in rotation within a vertical sleeve 120 which, in accordance with the invention, can be moved and then locked extremely rapidly in any position on the table 4.

To this end, the sleeve 120 is carried by and rigidly fixed to a base member 121 which is capable of sliding radially with respect to the axis 7 on the top face 8 of the table 4 along a radial member 122 which is capable of pivoting freely about the axis 7. By way of example, the member 122 is provided with two parallel and horizontal rods 123 and 124 which are disposed in symmetrical relation respectively on each side of the mean direction of the radial member, said direction being oriented radially with respect to the axis 7. Two parallel sleeves are capable of sliding freely along said rods 123 and 124 and are arranged in a complementary manner in the base member 121, preferably with interposition of any suitable means for facilitating the sliding movement.

The two rods 123 and 124 are rigidly coupled together, on the one hand in proximity to the axis 7 by means of a member 125 which is mounted so as to be capable of rotating freely about said axis with respect to the table 4 but secured against translational displacement along said axis and, on the other hand, in proximity to the periphery 10 of the table 4 by means of a member 126 which is placed astride said periphery. Beneath the rim defined around the entire periphery of the table 4 by that zone of the table face 9 which is located externally of the skirt 11, the member 126 aforementioned is provided with two claws 127 and 128 for securing said member against translational motion in a direction parallel to the axis 7 while permitting translational displacement of said member along the entire periphery 10 of the table 4 which is completely freed for this purpose as described earlier by causing the radial member 122 as a whole to rotate about the axis 7.

It is thus possible to bring the clamp 119 proper into position vertically above any zone of the table 4 by rotating the member 122 about the axis 7 and sliding the base member 121 along the rods 123 and 124.

Locking in the required position is performed in a single operation by means of a shoe which is placed beneath the base member 121 and which can be pressed at will against the top face 8 of the table 4 by means of a lever 129 whilst the member 125 and the claws 127 and 128 prevent the base member 121 from moving away from said face 8.

It will clearly be understood that many other clamping systems could be employed without thereby departing from the scope of the invention.

Broadly speaking, it would also be possible to contemplate many alternative forms of construction of the machine with respect to the form of construction described with reference to the accompanying drawings, without thereby departing from the scope or the spirit of the invention.

In particular, it would be possible to contemplate a different form of construction of the means for comparing the tension which is applied by the racket string to the anchoring means 37 for subjecting said string to a tractive force as a result of translational displacement of said means with the predetermined tension to be established, and of the related means for displaying said predetermined tension.

Furthermore, it would also be possible to contemplate a number of additional arrangements, especially with a view to achieving enhanced operational safety of the machine.

By way of example, such additional arrangements include end-to-travel switches which are provided in the example illustrated for detecting the end positions of the carriage 69 and initiating automatic changeover of the direction of rotation of the motor 62 when one of the end-of-travel switches is actuated.

The arrangement of the corresponding circuits is within the capacity of those versed in the art.

There has also been illustrated, especially in FIGS. 4 and 6, a safety device for ensuring that any faulty manual operation by the machine operator cannot result in overstepping of the tension displayed by means of the graduated knob 109.

Provision is accordingly made for means such that, at the time of rotation of the small plate 105 in the direction of the arrow 101, overstepping of the position in which said small plate is interposed between the magnet 113 and the flexible-blade switch 112 does not initiate re-starting of the motor 62 in the direction of increasing tensions.

To this end and as described in the foregoing, the arm 114 which carries the magnet 113 is not coupled directly to the disk 111 which carries the flexible-blade switch 112 but is restored elastically by a spring 115 against a stop 117 so arranged as to place the magnet 113 and the flexible-blade switch 112 opposite to each other. As a complementary feature, the arm 103 is adapted to carry a stop 131 which projects towards the cheek 74 and in the upstream direction considered in relation to the direction of the arrow 101. The intended path of said stop 131 intersects the path of the arm 114. In consequence, overstepping by the small plate 105 of the position in which it is interposed between the elements 112 and 113 is accompanied by bringing into contact of the stop 131 and the arm 114 and by displacement of said arm 114 by the arm 103 with concomitant tensioning of the spring 115. Thus the fact that the small plate 105 is no longer placed opposite to the switch 112 whereas this latter remains motionless during this overshoot does not again cause said switch 112 to be subjected to the action of the magnetic field of the magnet 113 and does not cause re-starting of the motor 62. The rotation can continue until the end-of-travel switches mentioned earlier come into operation and initiate automatic stopping of the motor or rotation of this latter in the opposite direction so as to bring the carriage 69 and the assembly 38 to their position of closest proxmity to the table 4. At the time of rotation of the arm 103 in the direction opposite to the arrow 101 which accompanies a decrease in racket-string tension, the spring 115 restores the arm 114 to a position in which it is in contact with the stop 117 or in other words to the position in which the magnet 13 carried by said arm is located opposite to the flexible-blade switch 112, thus restoring the system to its initial state.

As will readily be apparent, the embodiment of the present invention which has been described in the foregoing is given solely by way of indication and other modes of execution could accordingly be adopted without thereby departing either from the scope or the spirit of the invention.

Moreover, FIGS. 7 to 10 illustrate another embodiment of the racket-stringing machine in accordance with the invention.

The corresponding machine first comprises a base 1*a* of substantially parallelepipedal shape. On the top face 2*a* of the base is mounted a horizontal table 3*a* having the shape of a disk and capable of rotating about the pivot-pin 4*a* located at the center of this latter.

Two substantially vertical arms 5*a* and 6*a* which are rigidly fixed to the disk 3*a* and diametrically opposite with respect to the center of this latter are adapted to support respectively two half-cradles 7*a* and 8*a*. These half-cradles are coplanar and have a rounded concave shape in oppositely-facing relation to each other. Their relative spacing is adjustable in order to permit adaptation to the racket frame which is represented diagrammatically in the figure by the chain-dotted line 9*a* as well as to permit positioning and locking of the frame. To this end, two hooks 10*a* and 11*a* which are rigidly fixed respectively to each half-cradle apply the racket frame against these latter.

The assembly consisting of the racket, the half-cradles, the arms and the disks is capable of rotational displacement about the substantially vertical pivot-pin 4*a*. An operating handle 12*a* which is preferably located on the top face 2*a* of the base controls a brake which exerts braking forces of different intensities on the disk. Said operating handle makes it possible to obtain a slight braking action so as to permit manual rotation of the disk about the pivot-pin by means of a low effort and also serves to lock the disk securely in position with respect to the base of the machine during the racket-string tensioning operation.

Figure 7:
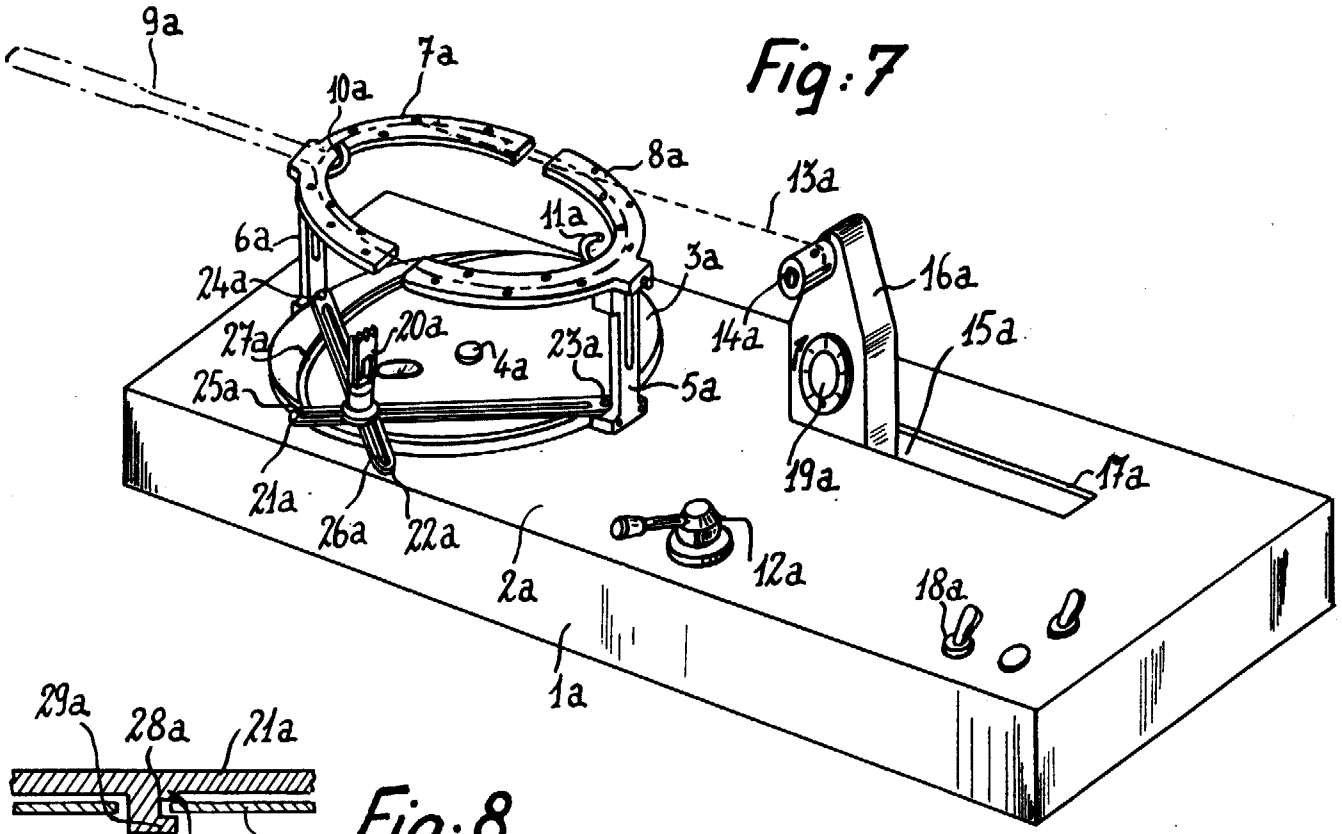
FIG. 7 is a view in perspective showing another embodiment of the racket-stringing machine in accordance with the present invention.

The string to which it is desired to apply tension is represented diagrammatically in FIG. 7 by the dashed line 13*a* and engaged between the two jaws of an anchoring device 14*a* which is rigidly fixed to a tensioning assembly. This assembly comprises a carriage 15*a* located inside the base of the machine, the displacement of said carriage being controlled by an electric motor which is also located inside the base. The movement of the carriage is a movement of translation which is intended to cause the displacement of the arm 16*a* within an elongated slot 17*a*, the anchoring device 14*a* being rigidly fixed to said arm 16*a*. During its movement of translation which applies tension to the racket string, the anchoring device 14*a* moves away from the racket frame. An electric control device 18*a* serves to start-up the carriage-driving motor, to stop said motor and return this latter to its initial position. The desired tension of the racket string is indicated on a display knob 19*a* and the movement of withdrawal of the anchoring device 14*a* is stopped when the tension of the string attains the displayed value.

When the desired string tension is attained, it proves necessary to fasten this latter temporarily in order to handle the end of the string and to re-insert it in the racket frame. The string is preferably fastened in position from the interior of the frame. It is then possible to slacken that portion of the string which is located outside the frame and to handle this latter.

In order to carry out this operation, a clamp 20*a* provided with jaws is positioned in such a manner as to ensure that these latter clamp the racket string against the racket frame, secure the string in position and maintain it temporarily under tension.

In order to ensure that this fastening operation is efficient, the clamp must in turn be locked in rigidly fixed relation to the disk when these jaws are in position with respect to the racket string.

In accordance with the present invention, two articulated arms 21*a* and 22*a* define the positioning of the clamp 20*a* at their point of intersection. These arms are capable of rotating freely about vertical pivot-pins 23*a* and 24*a*, said pivot-pins being located in proximity to the two arms 5*a* and 6*a* on which are fixed the two half-cradles for supporting the racket. Preferably, the two pivot-pins 23*a* and 24*a* are integrated in the arms 5*a* and 6*a* which support the half-cradles.

The length of each arm 21*a*, 22*a* is slightly smaller than the distance between the two supporting arms 5*a* and 6*a* in order that they may each be operated over the entire surface of the disk 3*a*. Said arms are of slightly different height in order that they may be mounted astride each other at their point of intersection.

Each arms 21*a*, 22*a* is provided with a horizontal slot 25*a* and 26*a* respectively which extends over the greater part of the length of said arms.

At the point of intersection of the two arms which defines the position of the clamp, the slots define a lozenge-shaped opening. The clamp 20*a* is mounted on a pin which passes through the opening defined by the intersection of the two slots and serves to mount the clamp in position.

In a preferential embodiment, the lower arm or in other words the arm 21*a* in the case of FIG. 7 is maintained in its rotational displacement by a lug which is rigidly fixed to this latter and travels in a groove 27*a* cut in the disk. This groove has a substantially circular shape and is centered on the axis of rotation of the arm 21*a*.

Figure 8:
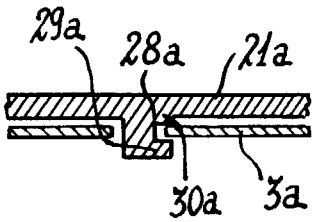
FIG. 8 is a fragmentary sectional view showing a detail of FIG. 7.

The lug and the groove are more particularly illustrated in FIG. 8. The lug has a vertical portion 28*a* and a horizontal portion 29*a* which is parallel to the direction of the longest dimension of the arm 21*a*. The groove which receives the lug has a cross-section corresponding to the shape of this latter and the upper portion of the lug has a horizontal portion 30*a* which is applied against the top face of the groove. Rotational displacement of the arm, however, is permitted by the circular shape of the groove.

As a result of rotational motion of the arms about their respective axes, the clamp can be displaced in a substantially horizontal plane and positioned at any point defined by the point of intersection of the two slots of each arm.

Figure 10:
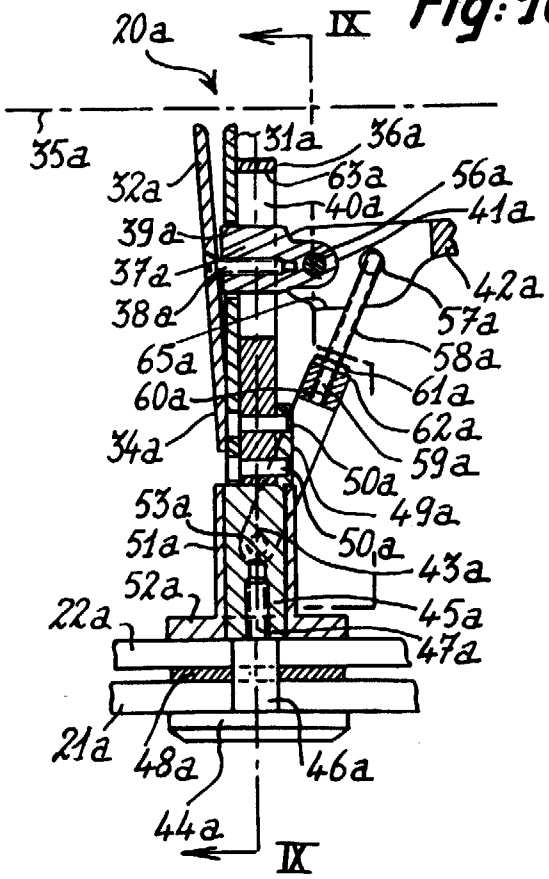
FIG. 10 is a side view taken in cross-section along line X—X of FIG. 9.
Figure 9:
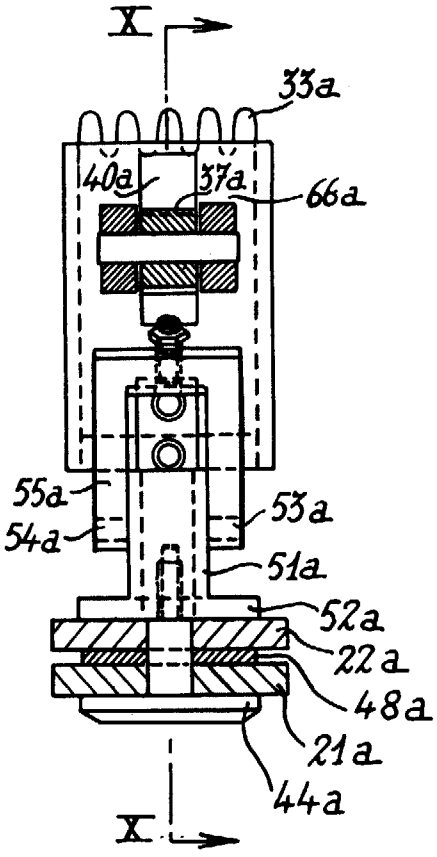
FIG. 9 is a part-sectional front view of the device provided in said machine for stationarily fixing the racket string under tension.

FIGS. 9 and 10 relate more especially to the clamp and to the manner in which this latter is mounted on the two arms. The clamp has several degrees of freedom; in the first place, said clamp is capable of moving in the horizontal plane as a result of displacement of the two arms and can also be displaced both in height as well as in a movement of rotation about its own axis.

The clamp 20*a* is provided firstly with two jaws, namely a stationary jaw 31*a* and a movable jaw 32*a*. The upper portion of each jaw is provided with teeth 33*a* located horizontally. The teeth of each jaw are located respectively in oppositely-facing relation. The relative spacing of said teeth corresponds to the spacing of the strings on the racket so that the teeth can accordingly be interposed between these latter.

In a preferential embodiment, the jaws are coupled together by screwing in the lower portion thereof and the lower end 34*a* of the movable jaw has been slightly tapered on the internal face at the level of its assembly with the stationary jaw. This tapered end portion has the effect of slightly opening-out the movable jaw with respect to the stationary jaw and their respective internal surfaces thus form a V having a small angular aperture within which the racket string 35*a* can be introduced.

Clamping of the two jaws is obtained by drawing the movable jaw against the stationary jaw and by utilizing the elasticity of said movable jaw. The device for producing the clamping action will be described hereinafter.

The assembly formed by the two jaws is capable of vertical sliding motion along a guide plate 36*a*. This vertical sliding motion serves to lift the jaws of the clamp and to engage them on each side of the racket string to be fastened in position.

The guide plate 36*a* is provided with a slot 40*a* which has its opening on each of the two larger faces of the plate 36*a*. Said slot has a substantially rectangular shape and its greatest dimension is oriented in the vertical direction. A member 37*a* which is capable of displacement in sliding motion through said slot has a substantially rectangular cross-section and is slightly smaller in width than the member which traverses the jaw 31*a* through the hole 39*a*.

Furthermore, said member is rigidly fixed to the movable jaw by means of a screw 38*a*. The member 37*a* is capable of vertical displacement along the slot 40*a* and is accompanied in its movement by the movable jaw and the stationary jaw. The length of the slot is so determined that, in the bottom position, the clamp is below the level of the racket strings represented schematically by the chain-dotted line 35*a* and that, in the top position, the racket string to be fastened in position penetrates into the interior of the jaws. It should be noted that, in this case, any racket strings located transversely with respect to the strings to be secured are positioned between the teeth 33*a* of the two jaws.

The member 37*a* is provided in addition with a rounded portion 41*a* on which is engaged an operating handle 42*a*, the design function of which will be described hereinafter.

The assembly formed by the two jaws of the clamp and the plate 36*a* is coupled together by means of a pivot 43*a* on which said assembly is pivotally mounted. Said pivot has a substantially vertical axis and passes through a lozenge-shaped opening defined by the intersection of the two respective slots 25*a* and 26*a* of the two arms. The pivot 43*a* is made up of two sections 45*a* and 46*a* which are assembled together by screwing at 47*a*. The section 46*a* is provided at the lower end thereof with a head 44*a* whose bearing surface is in contact with the bottom surface of the lower arm 21*a*. At the upper end, said section 46*a* is provided with a threaded portion screwed into an internally-threaded coaxial bore of the section 45*a* in order to carry out the assembly of these two sections.

Preferably, a washer 48*a* is interposed in the section 46*a* of the pivot between the two arms. Said washer serves to prevent frictional contact of the two arms against each other.

The non-threaded length of the section 46*a* of the pivot corresponds substantially to the height of the two arms and of the washer 48*a*. The diameter of the non-threaded portion is substantially equal to the width of the respective slots 25*a* and 26*a* of the two arms 21*a* and 22*a*.

The upper section 45*a* of the pivot 43*a* is coaxial with the section 46*a* and provided at the upper end with a lug 49*a* which is displaced with respect to the axis of the two sections 45*a* and 46*a* of the pivot. Said lug 49*a* has a substantially flat portion on the side nearest the axis on which the bearing plate 36*a* is fixed by means of a screw 50*a*, for example. Said screw 50*a* therefore serves to assemble together the bearing plate 36*a* and the pivot 43*a*.

The diameter of the upper section 45*a* of the pivot is slightly larger than the diameter of the non-threaded length of the section 46*a*.

A cylindrical sleeve 51*a* is slidably mounted for vertical displacement on the section 45*a* of the pivot 43*a*. Said cylindrical sleeve has an internal diameter which is substantially equal to the external diameter of the section 45*a*. The lower portion of said cylindrical sleeve is provided with an annular shoulder 52*a* which is intended to be applied against the top surface of the upper arm 22*a*. Said cylindrical sleeve is provided with two substantially horizontal, diametrically opposite and coaxial cross-pins 53*a* and 54*a* which project with respect to the vertical external surface of the cylindrical sleeve 51*a*.

A U-shaped stirrup-piece 55*a*, each wing of which is provided with a substantially horizontal bore having a diameter which is substantially equal to the diameter of the cross-pins 53*a* and 54*a* is pivotally mounted so as to be capable of rotation with respect to the cylindrical sleeve about the horizontal cross-pins aforesaid.

An operating handle 42*a* serves to place the clamp in position with respect to the racket string to be fastened and then to lock said clamp in position. Said operating handle is provided first of all with an end portion of known shape (not shown in FIG. 10) which permits easy manipulation of the operating handle. At the other end of the handle nearest the clamp, said handle is designed in the form of a yoke in which the member 37*a* is intended to fit. A horizontal pivot-pin 56*a* is passed right through the operating handle and the member 37*a*, thus permitting rotation of the operating handle with respect to said member 37*a* in a substantially vertical plane.

A second pivot-pin 57*a* which is parallel to the pivot-pin 56*a* passes right through that portion of the operating handle which has the shape of a yoke. A stud 58a is fixed on the second pivot-pin 57a at right angles to this latter and substantially at the mid-point thereof. Said stud 58a is therefore capable of pivotal displacement with the horizontal pin 57a. The end portion 59a of the stud 58a is threaded and penetrates into a bore 60a which is pierced in the upper portion of the stirrup-piece 55a. Said bore 60a is positioned in such a manner as to ensure that the stud 58a is capable of sliding freely within this latter at the time of displacement of the operating handle. A nut 61a screwed on the threaded portion of the stud 58a makes it possible to limit the range of travel of this latter within the bore 60a by bearing on the top face of the stirrup-piece.

When the handle is subsequently displaced in the downward direction, the stud 58a slides within the bore 60a of the stirrup-piece 55a until the nut 61a is abuttingly applied against the top bearing face 62a of the stirrup-piece. When the abutting application has taken place, the operating handle exerts a light pressure on the cylindrical sleeve 51a which produces a slight clamping action between the two arms 21a and 22a by means of its annular shoulder 52a. The operating handle 42a and the cylindrical sleeve 51a are pivotally coupled to each other on the one hand by means of the pins 57a and on the other hand by means of the pivot-pins 53a and 54a of the cylindrical sleeve. The remaining travel of the operating handle produces a pivotal movement of this latter with respect to the pivot-pin 57a and therefore a movement of upward displacement of the pivot-pin 56a. Said pivot-pin 56a is accompanied in its movement by the member 37a and also by the two jaws 31a and 32a of the clamp. The upward movement of the two jaws of the clamp stops when the top face of the member 37a is abuttingly applied against the upper end 63a of the slot 40a. The height at which the two jaws of the clamp as well as the member 37a are abuttingly applied is so determined as to ensure that the jaws of the clamp and more particularly the teeth 33a of this latter are upwardly displaced to the level of the rounded portion 41a or in other words to the level of the racket string to be stationarily fixed in position.

It is worthy of note that, when the member 37a comes into abutment at the end of the slot of the bearing plate, the operating handle exerts an upward vertical tractive force on the pivot 43a by means of the relatively-displaced lug 49a. This tractive force is transmitted by the two sections 45a and 46a of the pivot 43a and the head 44a to the lower arm 21a. By reason of the fact that the operating handle also exerts a thrust on the cylindrical sleeve 51a, the two arms 21a and 22a are clamped and exert a pressure on each other by means of the washer 48a. In the third part of the range of travel of the operating handle, the two pins 56a and 57a undergo a pivotal displacement with respect to each other, the pin 56a exerts an upward tractive force on the pivot 43a and the pin 57a exerts a thrust on the cylindrical sleeve 51a by means of the stirrup-piece 55a. This third part of the range of travel therefore has the effect of powerfully clamping the two arms 21a and 22a and locking these latter in position with respect to each other. By reason of the fact that these arms pivot about pins 23a and 24a which are rigidly fixed to the disk 3a, the two arms and the clamp are accordingly immobilized with respect to the disk.

Moreover, the pivot 43a on which the clamp is pivotally mounted is immobilized as a result of clamping of the two arms 21a and 22a since said pivot takes part in the clamping action.

Furthermore, in the third part of the movement of travel, a boss 65a comes into contact with the two zones 66a and 67a of the bearing face 36a which extends along the slot 40a. As a consequence, a tractive force is applied to the movable jaw by means of the member 37a, said movable jaw is displaced towards the stationary jaw and this latter therefore closes against the racket string to be fixed in position.

The screw 38a which couples the movable jaw to the member 37a serves to adjust the position of said jaw with respect to the pivot-pin 56a. By tightening said screw to a greater or lesser extent, it is possible to adjust the spacing of the movable jaw with respect to the stationary jaw and therefore the clamping force exerted by the two jaws on the racket string. Depending on the diameter of the string to be stationarily fixed, it will therefore be possible to adjust said screw in order to adapt the clamp to this latter.

In regard to the clamping force exerted on the two arms 21a and 22a, this force can be adjusted by the nut 61a which is mounted on the stud 58a. Depending on the position of this latter, the stud 58a will penetrate to a greater or lesser depth within the bore 60a and the thrust exerted on the cylindrical sleeve 51a will be more or less substantial.

As will readily be understood, that surface of the operating handle which is in contact with the two zones 66a and 67a has any suitable shape which places this latter in a stable locking position at the end of its movement towards the bottom position.

It should be noted that the operating handle 42a in fact controls two different clamps, one clamp being formed by the head 44a of the pivot 43a and the cylindrical sleeve 51a and the other clamp being formed by the two jaws 31a and 32a of the clamp which serves to secure the racket string. Both clamps are provided with respective means for adjusting the clamping force, namely the nut 61a of the stud 58a for clamping the two arms together and the screw 38a for clamping the two jaws together. During the movement of the operating handle, final clamping of the two arms 21a and 22a takes place prior to final clamping of the racket string by the two jaws 31a and 32a.

An important feature lies in the fact that both clamps are controlled by the same operating handle but are adjustable independently of each other and are not subject to any interaction in their clamping intensity by reason of the fact that the clamping of the two arms takes place as a result of a vertical movement and the movement of the clamp takes place in a horizontal direction. Clamping of the racket string is therefore not influenced by the intensity of the clamping force applied on the two arms and the string will therefore not be damaged by excessive clamping. This is most important in the case of fine racket strings since the adjustment provided by means of the screw 38a is such that strings are not liable to be flattened by the clamp.

Splitting-up or breakdown of the movements is permitted by the relatively displaced positions of the two pivot-pins 56a and 57a which are located in an approximately horizontal plane when the operating handle is unlocked and which are placed in an approximately vertical plane one above the other when the operating handle is locked.

When the racket-stringing machine has been put into operation and the racket string has been placed in position and then tensioned, the clamp is moved into position beneath the racket string to be stationarily secured, preferably against the racket frame, by displacing the two arms 21a and 22a. The jaws of the clamp are then oriented in a direction parallel to the racket string to be stationarily secured. Finally, by displacing the operating handle 42a, the two arms whose point of intersection defines the position of the clamp in a horizontal plane are first clamped lightly together, the jaws of the clamp are lifted to the level of the racket string to be stationarily secured, whereupon the two arms are powerfully clamped together and the jaws are reclosed. As can readily be understood, it is only necessary to unlock the operating handle by lifting this latter in order to release the clamp in its different degrees of freedom.

What is claimed is:

1. In a racket-stringing machine comprising a supporting table, and on the supporting table a cradle for locking a racket frame in position, a movable clamp 20a for temporarily immobilizing a racket string, means for applying tension to a racket string which is stationarily secured by means of said movable clamp in one zone of the frame, and means mounting said tensioning means freely displaceably in sliding motion in a second zone of said frame as a result of a tractive force exerted on one zone of the racket string located beyond the second zone with respect to the first; the improvement comprising two substantially horizontal arms 21a, 22a on which said movable clamp 20a is mounted, said arms being located at slightly different heights and being rotatably displaceable about spaced vertical axes 23a, 24a located on each side of the cradle in diametrically opposite relation as seen from above, the length of each said arm being shorter than the distance between said two axes 23a, 24a and the point of intersection of said arms being such as to describe at least the entire internal surface of the racket frame and part of the periphery of said frame.

2. A machine according to claim 1, wherein the arms 21a, 22a are provided respectively with a substantially horizontal slot 25a, 26a which has a length in the vicinity of the length of said arm and the point of intersection of which slots describes at least the entire internal surface of the racket frame and part of the periphery of said frame.

3. A machine according to claim 2, wherein said movable clamp 20a is secured on a support 43a comprising a vertical pivot 46a rotatably engaged through the opening defined by the intersection of the respective slots of each arm 21a, 22a.

4. A machine according to claim 3, wherein said vertical pivot 46a of the support 43a of said movable clamp 20a comprises a head 44a situated under said pivoting arms 21a and 22a, and the movable clamp 20a has an operating handle 42a adapted to cause the clamping of said pivoting arms 21a and 22a in order to lock said movable clamp in position.

5. Machine according to claim 4 wherein the support 43a of the movable clamp 20a has a sliding sleeve 51a applied against the upper pivoting arm 22a, said operating handle 42a being adapted to cause the clamping of the pivoting arms 21a and 22a between said sliding sleeve 51a and the head 44a of the pivot 46a.

6. Machine according to claim 5 wherein said movable clamp 20a comprises a fixed jaw 31a and a movable jaw 32a situated in front of a bearing plate 36a rigidly fixed to the support 43a, said plate having a vertical slot 40a in which slides a connecting member 37a secured on said movable jaw 32a and passing through said fixed jaw 31a, and said operating handle 42a is pivotally mounted on an axis 56a on said connecting member 37a and comprises a cam 65a adapted to bear against said bearing plate 36a in order to clamp the jaws 31a, 32a when said operating handle 42a is pivoted.

7. Machine according to claim 5, wherein said operating handle 42a is connected to the sliding sleeve 51a by means of connection means 55a, 58a articulated on the one hand on said sliding sleeve 51a and on the other hand on said operating handle 42a about an axis 57a spaced from an axis 56a on which the connecting member 37a is articulated.

8. Machine according to claim 6 wherein said movable jaw 32a is secured on said connecting member 37a by means of a screw adapted to adjust the spacing of the two jaws and the force of clamping of the racket string.

9. Machine according to claim 7, wherein said connecting means situated between said operating handle 42a and said sliding sleeve 51a comprises a screw 58a and a nut adapted to adjust the force of clamping of the two pivoting arms 21a and 22a.

10. Machine according to claim 7 wherein, in the locking position of the operating handle 42a, the two relatively displaced cross-pins 56a and 57a are positioned substantially one above the other and exert a tractive force on the support 53a of the clamp and on the head 44a thereof as well as a thrust on the cylindrical sleeve 51a so as to clamp the two pivoting arms 21a, 22a one against the other and immobilize said clamp 20a with respect to its pivot, whereupon said cam 65a of the operating handle 42a is in contact with the bearing plate 36a and closure of the two said jaws 31a, 32a is thus effected.

11. In a racket-stringing machine comprising a supporting table, and on the supporting table a cradle for locking a racket frame in position, a movable clamp 20a for temporarily immobilizing a racket string, means for applying tension to a racket string which is stationarily secured by means of said movable clamp in one zone of the frame, and means mounting said tensioning means freely displaceably in sliding motion in a second zone of said frame as a result of a tractive force exerted on one zone of the racket string located beyond the second zone with respect to the first; the improvement in which said means for applying tension to a racket string comprises:

a carriage located externally with respect to the cradle and having means for anchoring said racket-string zone;

means for guiding and displacing the carriage in translational motion in the direction of withdrawal or approach with respect to the cradle in order to apply a tractive force to the racket string;

means mounting the anchoring means on the carriage for rotation with respect to the carriage about an axis at right angles to the direction of said translational motion;

means acting elastically in opposition to said movement of rotation; and means for comparing the instantaneous angular position of the anchoring means with a predetermined angular position corresponding to the application of predetermined oppositely-acting force to the anchoring means by the racket string and by the means for acting elastically in opposition to the rotation of the anchoring means.

12. Machine according to claim 11 wherein the means for comparing the instantaneous angular position of the coupling member with a predetermined angular position comprise a lug adapted to be rotated by the anchoring means and means for detecting said lug as it moves into said predetermined angular position, the last-named means comprising, in said predetermined angular position, in oppositely-facing relation respectively on each side of the intended path of said lug during its rotational motion, a magnet and a flexible-blade switch for controlling the displacement of the carriage in the direction of withdrawal with respect to the cradle so as to permit said displacement when said switch is closed by the action of the magnetic field of the magnet and to open said switch when it is no longer subjected to said action, and wherein the lug has a magnetic screen for isolating the flexible-blade switch and the magnet when said lug occupies said predetermined angular position.

13. Machine according to claim 12, and means for adjusting said predetermined tension, said means comprising means for adjusting the position of the detecting means along the intended path of the lug.

* * * * *